US007322503B2

(12) United States Patent
Odoni et al.

(10) Patent No.: US 7,322,503 B2
(45) Date of Patent: Jan. 29, 2008

(54) SETTING TOOL WITH MAGAZINE WITH FASTENING ELEMENTS AND PROPELLANT HOLDER FOR THE SETTING TOOL

(75) Inventors: Walter Odoni, Planken (LI); Ulrich Rosenbaum, Wangs (CH); Bernard Favre-Bulle, Vienna (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 11/185,274

(22) Filed: Jul. 19, 2005

(65) Prior Publication Data

US 2005/0252945 A1 Nov. 17, 2005

Related U.S. Application Data

(62) Division of application No. 10/834,584, filed on Apr. 29, 2004, now abandoned.

(30) Foreign Application Priority Data

May 2, 2003 (DE) ..... 103 19 647

(51) Int. Cl.
*B27F 7/00* (2006.01)

(52) U.S. Cl. ..... 227/10; 227/9; 227/2; 227/136

(58) Field of Classification Search ..... 227/10, 227/9, 3, 2, 120, 130, 136
See application file for complete search history.

(56) References Cited

U.S. PATENT DOCUMENTS

| | | | | |
|---|---|---|---|---|
| 4,858,811 | A * | 8/1989 | Brosius et al. | 227/10 |
| 5,177,318 | A * | 1/1993 | Martinez et al. | 89/46 |
| 5,661,887 | A * | 9/1997 | Byrne et al. | 29/243.525 |
| 5,666,710 | A * | 9/1997 | Weber et al. | 29/243.523 |
| 5,794,831 | A * | 8/1998 | Velan et al. | 227/2 |
| 6,123,241 | A * | 9/2000 | Walter et al. | 227/8 |
| 6,739,490 | B1 * | 5/2004 | Shkolnikov et al. | 227/2 |
| 6,783,047 | B2 * | 8/2004 | Granacher | 227/10 |
| 6,796,476 | B2 * | 9/2004 | Birk et al. | 227/2 |
| 2003/0047064 | A1 * | 3/2003 | Dittrich et al. | 89/35.01 |

* cited by examiner

*Primary Examiner*—Brian D. Nash
(74) *Attorney, Agent, or Firm*—Abelman, Frayne & Schwab

(57) ABSTRACT

A setting tool for driving fastening elements in a constructional component includes a setting mechanism located in the tool housing (21) and including a drive piston (7) for driving a fastening element (6) in the constructional component (1), a reading device (10) for acquiring information containing in a coding (8) provided on a magazine strip (27) containing the fastening element (6), and control device (15) communicating with the reading device (10) for adjusting setting parameters for a setting process dependent on data acquired by the reading device (10) upon reading out the coding (8).

6 Claims, 2 Drawing Sheets

SETTING TOOL WITH MAGAZINE WITH FASTENING ELEMENTS AND PROPELLANT HOLDER FOR THE SETTING TOOL

RELATED APPLICATIONS

This application is a division of application Ser. No. 10/834,584 filed on Apr. 29, 2004, now abandoned.

BACKGROUND OF THE INVENTION

1. Field of the Invention

The present invention relates to a setting tool, in particular to a combustion-engined setting tool, for driving fastening elements such as nails, bolts, pins, etc., in a constructional component and includes a setting mechanism located in the tool housing and having a drive piston for driving a fastening element in the constructional component. The present invention also relates to a magazine with fastening elements and a propellant holder for the setting tool.

2. Description of the Prior Art

Setting tools of the type described above can operate with liquid, gaseous, or solid fuels or be driven with pneumatic, mechanical, or electro-pneumatic drives.

The setting tools are used primarily for driving fastening elements, such as nails, bolts, pints and the like in concrete, steel, wood, etc. The quality of attachment depends, among others, from a correct adjustment of setting parameters, e.g. from adjustment of the setting energy that depends from a propellant, in particular, from a correct metering of liquid or gaseous fuel or the selection of a correct cartridge strength.

German Publication DE-OS 32 32 137 discloses an electrically driven setting tool in which one or several drive-in blows can be applied to a fastening element. The number of the drive-in blows is determined in advance based on preliminary selected elements and is set manually. This means that such setting parameter as the drive-in energy is adjusted manually. The manual adjustment of the drive-in energy and, thus, of a number of the drive-in blows are associated with increased costs and is a serious drawback.

U.S. Pat. No. 6,123,241 discloses a setting tool operated with a liquefied gas, and a magazine with fastening elements of which is provided with a switch that turns on when the magazine becomes empty. A turn-on condition of the switch is communicated to a microprocessor which evaluates the information and makes the information optically available to the user. A setting or drive-in process is not any more possible.

Known also are powder charge-operated setting tools (e.g., a setting tool DX A 40 MK of the assignee herein, firm catalogue 2001, Austria, page 53) in which the parameter "setting energy" is manually adjusted with a setting wheel. The adjustment is effected based on a fastening element, which is to be driven in, and on a cartridge strength. In incorrect setting parameters (e.g., setting energy) are present, a defective setting will take place.

Accordingly, an object of the present invention is to provide a setting tool of the type described above in which the drawbacks of prior art tools are eliminated.

Another object of the present invention is to provide a setting tool of the type described above in which setting parameters such as, e.g., setting energy and/or necessary number of drive-in blows, etc., are adjusted automatically, dependent on a to-be-driven-in, fastening element.

SUMMARY OF THE INVENTION

These and other objects of the present invention, which will become apparent hereinafter, are achieved by providing in a setting tool, a reading device for acquiring information containing in a coding provided on a magazine strip containing the fastening element, and a control device communicating with the reading device for adjusting setting parameters for a setting process dependent on data acquired by the reading device upon reading out the coding.

The present invention permits an automatic adjustment of setting parameters of the setting tool, such as a necessary setting energy and a number of piston strokes, without intervention of a tool user. Furthermore, the present invention permits to determine before the start of a setting process whether the available fastening elements, which are contained in the magazine or the magazine strip, are compatible, i.e., can be driven in with a particular setting tool. If not, the control device sets a setting parameter that prevents actuation of actuation mechanism, and/or ignition mechanism, and/or trigger switch. The setting tool cannot be actuated, and no damage can occur to the tool or done to the tool user.

Advantageously, the setting tool has a further device for acquiring information containing in a coding provided on a propellant holder, e.g., a fuel reservoir, a cartridge strip, or a blister box, which is arranged on the setting tool and which is connected with the control device for transmitting acquired data thereto, with the control device adjusting the setting parameters dependent on the data transmitted thereto form the further reading device.

The provision of the further reading device permits the control device of the setting tool to evaluate the fuel or the propellant and to calculate a setting parameter, e.g., the setting energy, the necessary amount of fuel, or the necessary throttling, e.g., of an exhaust throttle.

As discussed above, the setting energy is one of the most important setting parameters. For adjusting the setting energy, there is provided, according to the present invention, a regulation device which is controlled by the tool control device. The regulation device can, e.g., control a metering device when the setting tool is operated with a liquid fluid, or it can be formed as a chock in a powder charge-operated setting tool. The regulation device advantageously facilitate the automatic control of the setting energy in the inventive setting tool.

Advantageously, the regulation device or the control device itself distributes the setting energy of the setting tool on a number of separate blows applied by the drive piston. This has an advantageous effect, in particular, in tools having a relatively small power, as this permits to perform, with these tools, setting processes which require a large consumption of energy. This is because the setting energy is determined by the sum of energies of a plurality of separate blows.

Preferably, both of the reading devices include each a data reader. The data reader can be formed, e.g., as a tracer element that can scan a mechanically traceable coding. However, the data reader can be formed as an electronic receiver capable of scanning an electronic coding provided on the strip magazine and/or propellant holder.

A magazine with fastening elements is provided with a coding containing information or data regarding the type, dimensions, and/or field of application of the fastening elements containing in the magazine strip. The coding can be mechanically scanned, mechanically read-out or be electronic.

If the coding is formed as a mechanically traceable coding, it can be cost effectively formed as, e.g., grooves, recesses, a particular profile provided on the magazine or the magazine strip.

Advantageously, the propellant holder, e.g., a cartridge strip, a propellant box, or a fuel pressure reservoir, is also provided with coding containing data regarding type and properties of the propellant. This coding can likewise be read-out mechanically. It can also be read-out electronically. When the coding is formed as a mechanically traceable coding, it can be cost-effectively formed as recesses, grooves, or as a particular profile provided on the propellant holder.

According to an advantageous embodiment of the propellant holder, the holder has a data communication interface connected with the data storage identification unit. In the embodiment of an inventive propellant holder, which can be economically produced, the data storage identification unit is form as EEPROM or as magnetic strip.

In a further, economically produced propellant holder, the data communication interface is formed as an antenna, preferably, as a transponder antenna or as a contact element that cooperates with a mating contact element provided in the propellant holder receptacle of the setting tool.

The inventive propellant holder can be formed also, e.g., as a pressure can or pressure container for a gaseous and/or liquid fuel. However, the inventive propellant holder can be also formed as a box or a cassette for solid propellant charges in form of a cartridge or blister strip.

According to a further advantageous embodiment of the setting tool the data processing unit is connected with the ignition device or a device for shifting the ignition unit between operational and non-operational modes. In the operational mode of the ignition device, the setting tool can perform a setting process, as in this mode, the propellant is ignited by the ignition device.

According to a particular advantageous embodiment of the setting tool, the data processing unit actuates the ignition device for igniting the propellant when the following conditions are met, namely, (i) the data processing unit has received identification data which were read-out from a data storage identification unit of the propellant holder received in the receptacle of the setting tool and which are recognized by the data processing unit as authorized identification data of a propellant suitable for the setting tool; and (ii) and the propellant supply level data read-out from the data storage identification unit and communicated to the data processing unit indicate that the propellant holder is not empty.

This embodiment of the setting tool is particularly user-friendly.

In order to reduce the data transmission path between the data communication interfaces, which are provided, respectively, on the holder and the setting tool, to a most possible extent, the data communication interface of the setting tool is located in a region of the propellant holder receptacle. The data communication interface of the setting tool can be formed as antenna or as a transponder antenna, or a mating contact element, or a magnetic strip reader. The data communication interfaces (and other electronic components) of the propellant holder and the setting tool are adapted to each other to form an ideal propellant holder system.

The novel features of the present invention, which are considered as characteristics for the invention, are set forth in the appended claims. The invention itself, however both as to its construction and its mode operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
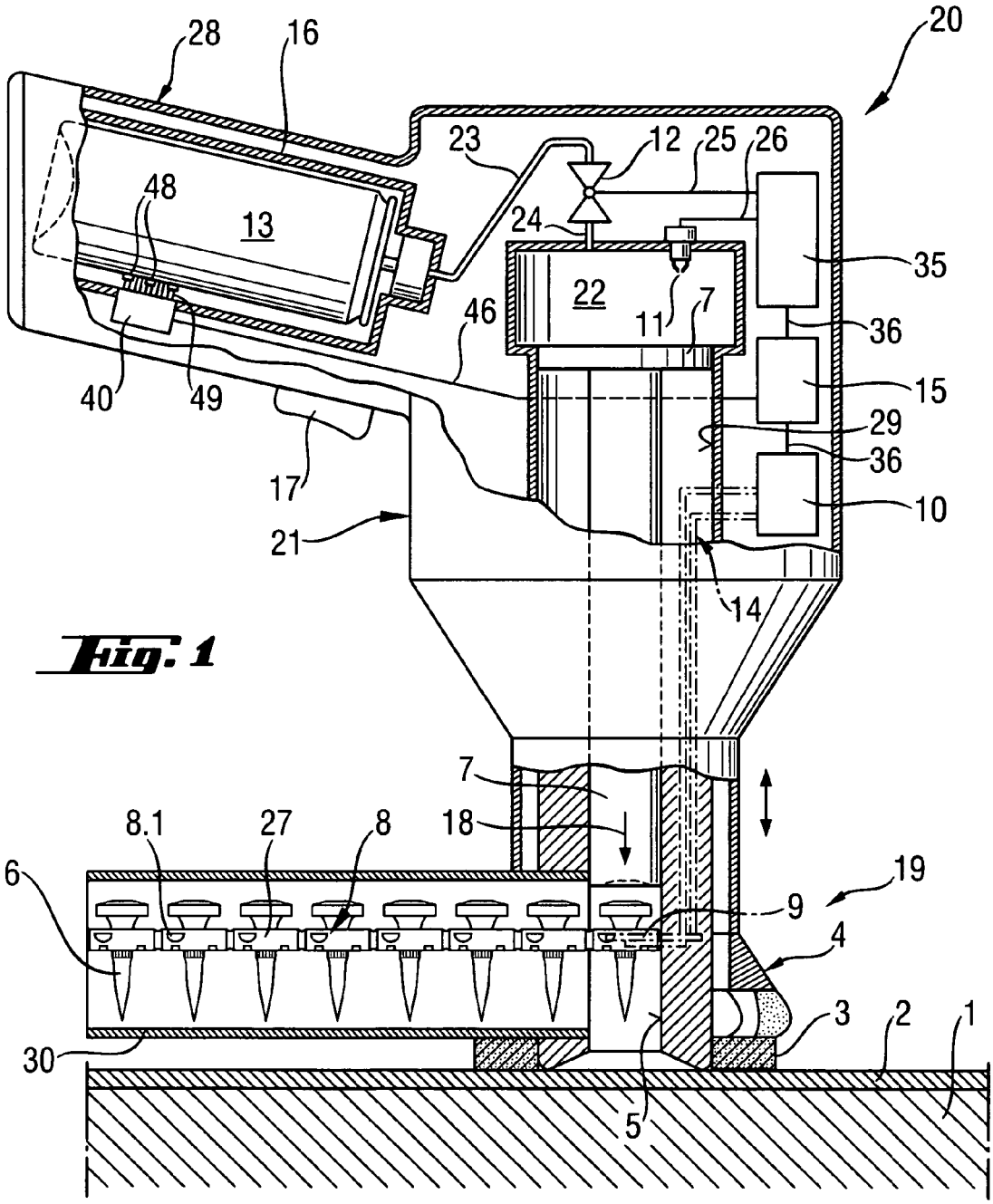
FIG. 1 a schematic, partially cross-sectional view of a setting tool according to the present invention, which is placed against a constructional component.

FIG. 1 shows a setting tool 20 according to the present invention which is pressed against a constructional component 1 to which a metal element 2 is to be fastened. The setting tool 20 has a housing 21 with a handle 28 formed integrally therewith. On the handle 28, there is arranged a trigger switch 17 with which a setting process is actuated. The setting tool 20 further includes a piston guide 29, a piston 7 displaceable in the piston guide 29, and a combustion chamber 22 adjoining the piston guide 29 and forming a part thereof. A bolt guide 5 adjoins the piston guide 29 in the setting direction 18 of the setting tool 20. At the front, in the setting direction 18, end of the bolt guides, a magazine 30 with fastening elements 6 is provided. The setting tool 20 has a receptacle 16 in which a replaceable propellant holder 13 is arranged. In the embodiment shown in FIG. 1, the propellant holder 13 is formed as a pressure container for a liquid fuel, e.g., liquefied gas. The propellant holder 23 is connected with a fuel conduit 23 in which a metering device 12, e.g. a metering valve is arranged. The metering device 12 is connected with a combustion chamber 22 by a fuel conduit 24. The fuel flows from the propellant holder 13 into the combustion chamber 22 through fuel conduits 23, 24 an the metering device 12.

In the combustion chamber 22, there is arranged an ignition device 11 with which an air-fuel mixture that fills the combustion chamber 22, is ignited. The metering device 12 and the ignition device 11 are connected by respective electrical conductors 25, 26 with a regulation device 35 for regulating the setting energy. An electrical conductor 36 connects the regulation device 35 with a control device 15. The control device 15, by controlling the regulation device 35, controls the number of piston strokes for a setting process and, thereby, a number of refillings of the combustion chamber 22 and a respective number of ignition processes performed by the ignition device 11. The control device 15 also controls, in combination with the regulation device 35 and the metering device 12, the combustion energy produced in the combustion chamber 22. The control device 15 can be formed as an integrated circuit and/or as a microprocessor. The regulation device 35 can also be formed as an electronic circuit or as an electromechanical regulation device, e.g., in case of a regulation of power, the regulation device 35 can be formed as a flue gas opening.

The setting device 20 further includes a reading device 10 for acquiring data contained in a coding and which is connected by appropriate data transmission means 14 with a data reader 9. The data reader 9 can be formed, e.g., as a tracer element or a filler. At the front of the bolt guide 5, there is provided an attachment element 4 formed as a magnetic flux coupler and including a permanent magnet 3.

With the permanent magnet 3, the setting tool 20 is placed against the metal element 2 so that it cannot be lifted from a selected setting point during the setting process.

Figure 2:
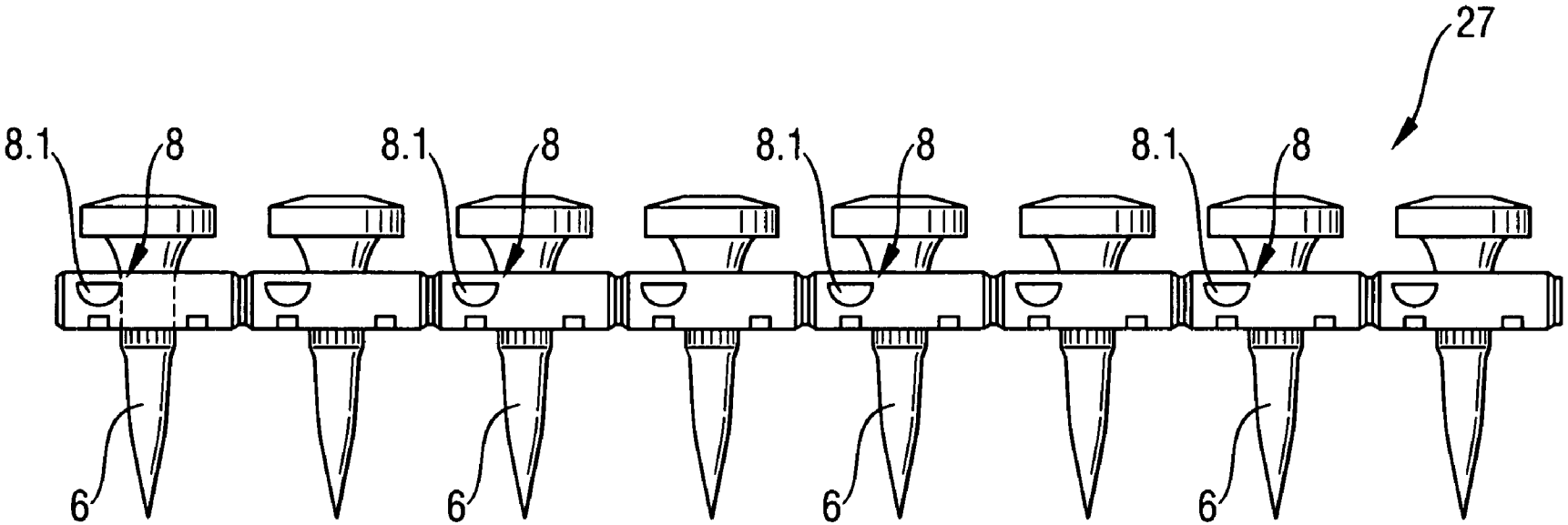
FIG. 2 a side view of a magazine strip for the inventive setting tool.

A magazine strip 27, which is shown in detail in FIG. 2, is located in the magazine 30. On the magazine strip 27, fastening elements 6, e.g., nails are arranged. The magazine strip 27 is also provided with a coding 8. The coding 8 contains information related to fastening elements 6, such as type (material, other particularities, etc.), dimensions (length, diameter, etc.), mechanical characteristics (e.g., stem stiffness), field of application (type of the material of the constructional component into which it can be set, e.g., steel concrete, wood, etc.). Based on this information or data, the control device 15 can determine setting parameters of a setting process, such as, e.g., the necessary setting energy, the necessary amount of fuel, the ignition pulse, and/or the number of piston strokes necessary to obtain the necessary setting energy. The data can also indicate whether a particular setting element 6 can be set with a particular setting tool, so that an actuation mechanism, and/or the trigger switch 17, and/or the ignition device 11 are(is) deactivated in case the setting element 6 is not compatible with the setting tool 20.

The coding 8 can be detected or read-out by the data reader 9 and be transmitted by the data transmission means 14 to the reading device 10. The data reader 9 can operate mechanically as it can be formed, as it has already been discussed above, as a tracer element.

The coding 8 can be formed, e.g., by one or several recesses 8.1, by grooves, by a specific profile, and as a bar code. An absence of a recess or a groove in the region of the coding 8 can also serve as information.

Also, the setting tool can include an electronic data storage. In this case, the data reader 9 and the data transmission means 14 are formed as electronic components/conduits electrically connected with the reading device 10.

In the reading device 10, the data are converted in an analog or digital electronic form and are transmitted to the control device 15 over the conductor 36 and are evaluated there. The control device 15 predetermines setting parameters for the following setting process such as, e.g., setting energy, amount of fuel, number of blows or piston strokes which are necessary for setting a fastening element 6. During the setting process, the setting tool 20 will be held at its setting region 19, against the metal element 2 overlying the constructional component 1, with the attachment element 4 and the permanent magnet 3 until the setting process is completed with a necessary number of piston strokes.

Another reading device 40 is provided in the region of the receptacle 16 and is connected with a data reader for reading out the coding 48 provided on the propellant holder 13. The coding 48 contains information related to the type and characteristics of the fuel or the propellant and its suitability for different setting tools. The information which is acquired by the reading device 40, is communicated in form of an analog or digital data to the control device 15 for further processing. In response to the received data, the control device 15 determines the amount of fuel necessary for effecting the setting process and, if necessary, the number of strokes required to obtain the necessary setting energy. Further, the coding 48 permits to ascertain whether the fuel in the propellant holder 19 is suitable for the setting tool 20. If not, the actuation mechanism, the trigger switch 17, and/or the ignition device 11 are deactivated.

In case of an explosion-operated setting tool, a coding similar to coding 48 on the propellant holder 13 is provided, e.g., on a cartridge strip or a cartridge box, etc. An appropriate reading device can be provided in an appropriate location of the setting tool for reading out the coded information and for transmitting the read-out information or data to a control unit of the setting tool.

Though the present invention was shown and described with references to the preferred embodiment, such is merely illustrative of the present invention and is not to be construed as a limitation thereof, and various modifications of the present invention will be apparent to those skilled in the art. It is, therefore, not intended that the present invention be limited to the disclosed embodiment or details thereof, and the present invention includes all variations and/or alternative embodiments within the spirit and scope of the present invention as defined by the appended claims.

What is claimed is:

1. A setting tool for driving fastening elements into a constructional component, comprising a housing (21); a setting mechanism located in the housing and including a drive piston (7) for driving a fastening element (6) into the constructional component (1); a magazine (30) attached to said housing; a magazine strip (27) having at least one of the fastening elements (6) and insertable into said magazine; a reading device (10) for acquiring information contained in a coding (8) provided on the magazine strip (27) with the fastening element (6), said coding containing information selected from a group containing dimensional characteristics, mechanical characteristics of the fastening element, its material characteristics, and its field of application; and a control device (15) communicating with the reading device (10) for adjusting setting parameters for a setting process dependent on data acquired by the reading device (10) upon reading out the coding (8).

2. A setting tool according to claim 1, wherein the control device includes means for actuating an actuation mechanism is accordance with the setting parameters.

3. A setting tool according to claim 1, further comprising a regulation device (35) for regulating a setting energy necessary for driving in a fastening element (6) and which constitutes one of the setting parameters, and wherein the control device (15) controls the regulation device (35).

4. A setting tool according to claim 1, wherein the reading device (10) is associated with a data reader (9).

5. A setting tool for driving fastening elements into a constructional component, comprising a housing (21); a setting mechanism located in the housing and including a drive piston (7) for driving a fastening element (6) into the constructional component (1); a magazine (30) attached to said housing; a magazine strip (27) having at least one of the fastening elements (6) and insertable into said magazine; a reading device (10) for acquiring information contained in a coding (8) provided on the magazine strip (27) with the fastening element (6); a control device (15) communicating with the reading device (10) for adjusting setting parameters for a setting process dependent on data acquired by the reading device (10) upon reading out the coding (8); and a propellant holder (13) located in said housing and having a second reading device (40) for acquiring information contained in a second coding (48) provided on the propellant holder (13) and connected with the control device (15) for transmitting acquired data thereto, with the control device (15) adjusting the setting parameters dependent on the data transmitted thereto from the second reading device (40).

6. A setting tool for driving fastening elements into a constructional component, comprising a housing (21); a setting mechanism located in the housing and including a drive piston (7) for driving a fastening element (6) into the constructional component (1); a magazine (30) attached to said housing; a magazine strip (27) having at least one of the fastening elements (6) and insertable into said magazine; a reading device (10) for acquiring information contained in a coding (8) provided on the magazine strip (27) with the fastening element (6); a control device (15) communicating with the reading device (10) for adjusting setting parameters for a setting process dependent on data acquired by the reading device (10) upon reading out the coding (8); and a propellant holder (13) located in said housing and having a second reading device (40) for acquiring information contained in a second coding (48) provided on the propellant holder (13) and connected with the control device (15) for transmitting acquired data thereto, with the control device (15) adjusting the setting parameters dependent on the data transmitted thereto from the first reading device (10) and the second reading device (40).

* * * * *